US007469890B2

(12) United States Patent
Aoki

(10) Patent No.: US 7,469,890 B2
(45) Date of Patent: Dec. 30, 2008

(54) PAPER SHEET SUPPLY APPARATUS

(75) Inventor: Takeshi Aoki, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 343 days.

(21) Appl. No.: 11/376,106

(22) Filed: Mar. 16, 2006

(65) Prior Publication Data

US 2007/0000748 A1 Jan. 4, 2007

(30) Foreign Application Priority Data

Jun. 29, 2005 (JP) ..... 2005-190680

(51) Int. Cl.
*B65H 1/26* (2006.01)

(52) U.S. Cl. ..... 271/157; 271/149; 271/160; 271/3.04; 414/795.8

(58) Field of Classification Search ..... 271/149, 271/157, 160, 3.01, 3.04; 414/795.8
See application file for complete search history.

(56) References Cited

U.S. PATENT DOCUMENTS

| | | | | |
|---|---|---|---|---|
| 3,915,338 | A * | 10/1975 | Kronseder et al. | 221/1 |
| 4,052,052 | A * | 10/1977 | Muller | 271/157 |
| 4,708,568 | A * | 11/1987 | Odorici | 414/798.7 |
| 4,750,743 | A * | 6/1988 | Nicoletti | 273/148 A |
| 4,799,605 | A * | 1/1989 | Kronseder | 221/11 |
| 4,953,748 | A * | 9/1990 | Wheelock | 221/59 |
| 5,141,127 | A * | 8/1992 | Graef et al. | 221/4 |
| 5,167,408 | A * | 12/1992 | Golicz | 571/149 |
| 5,211,529 | A * | 5/1993 | Esala et al. | 414/795.8 |
| 5,299,796 | A * | 4/1994 | Wooldridge | 271/9.01 |
| 5,398,931 | A * | 3/1995 | Tohgoh | 271/126 |
| 5,503,518 | A * | 4/1996 | Scholz | 414/790.4 |
| 5,829,742 | A | 11/1998 | Rabindran et al. | |
| 5,890,712 | A * | 4/1999 | Phillips et al. | 271/157 |
| 5,947,468 | A | 9/1999 | McKee et al. | |
| 6,247,694 | B1 * | 6/2001 | Nonnemacher et al. | 271/146 |
| 6,302,638 | B1 * | 10/2001 | Eggebrecht et al. | 414/798.7 |
| 6,354,587 | B1 * | 3/2002 | Engarto | 271/149 |
| 6,601,687 | B1 * | 8/2003 | Jenrick et al. | 194/206 |
| 6,622,911 | B1 * | 9/2003 | Holland-Letz et al. | 235/379 |
| 6,722,486 | B2 * | 4/2004 | Shibata et al. | 194/206 |
| 6,749,193 | B2 * | 6/2004 | Berdelle-Hilge et al. | 271/149 |
| 6,997,454 | B2 * | 2/2006 | Antonelli et al. | 271/214 |
| 7,182,331 | B2 * | 2/2007 | Berdelle-Hilge et al. | 271/150 |

FOREIGN PATENT DOCUMENTS

| | | |
|---|---|---|
| DE | DT 26 40 496 A1 | 3/1977 |
| JP | 06-80257 | 3/1994 |
| JP | 2002-160842 | 6/2002 |
| JP | 2004-157665 | 6/2004 |

OTHER PUBLICATIONS

European Search Report dated Feb. 28, 2007 for Appln. No. 06004625.7-1256.

* cited by examiner

*Primary Examiner*—Patrick H Mackey
*Assistant Examiner*—Prasad V Gokhale
(74) *Attorney, Agent, or Firm*—Pillsbury Winthrop Shaw Pittman LLP

(57) ABSTRACT

A paper money supply unit has a backup plate which presses paper money input to a first input unit to a pickup roller, and a support plate which supports a paper money additionally input to a second input unit. When the paper money additionally input to the second input unit is moved to the first input unit and joined with the paper money, the support plate supports the paper money by a pressing force in the direction reverse to a pressing force by the operator.

14 Claims, 5 Drawing Sheets

PAPER SHEET SUPPLY APPARATUS

CROSS-REFERENCE TO RELATED APPLICATIONS

This application is based upon and claims the benefit of priority from prior Japanese Patent Application No. 2005-190680, filed Jun. 29, 2005, the entire contents of which are incorporated herein by reference.

BACKGROUND OF THE INVENTION

1. Field of the Invention

The present invention relates to a paper sheet supply apparatus, which is incorporated in a paper sheet processing apparatus to process paper sheets such as paper money, and supplies paper sheets inputted in a stacked state.

2. Description of the Related Art

A conventional paper sheet supply apparatus has a supply table which inputs paper sheets by stacking in a stand-up state, and a backup plate which supports the rear end of the stacking direction of the paper sheets inputted in a stand-up state on the supply table and presses the paper sheets to a pickup roller provided at the front end of the stacking direction. (Refer to Jpn. Pat. Applin. KOKAI Publication No. 2004-157665, for example.)

When inputting paper sheets to the supply apparatus, the operator moves the backup plate in the direction of separating away from the pickup roller against the pressing force of the backup plate, and inserts paper sheets into a space made between the pickup roller and backup plate. Particularly, when inputting additional paper sheets, the operator must move the backup plate in the direction of separating away from the paper sheets already input to the supply table by holding the already input paper sheets, and insert the next paper sheets into a space made between the backup plate and the already input paper sheets. This deteriorates ease of operation by the operator.

BRIEF SUMMARY OF THE INVENTION

It is an object of the present invention to provide a paper sheets supply apparatus configured to improve ease of operation by the operator.

In order to achieve the above object, according to an aspect of the present invention, there is provided a paper sheet supply apparatus comprising a first input unit which inputs a first paper sheet by stacking in a stand-up state; a backup plate which presses a paper sheet placed at the other end of the direction of stacking the first paper sheet input to the first input unit in a first direction toward a pickup roller provided at one end of the first input unit, so as to press a paper sheet placed at one end of the stacking direction to the pickup roller; a second input unit which is connected continuously to the other end of the fist input unit and inputs a second paper sheet by stacking in a stand-up state; a support plate which is placed between the backup plate and second paper sheet, supports a paper sheet placed at one end of the direction of stacking the second paper sheet input to the second input unit, and presses the second paper sheet in a second direction reverse to the first direction along the stacking direction; and an evacuation mechanism which evacuates the backup plate and support plate from between the first paper sheet and second paper sheet, after pressing the second paper sheet in the first direction against the pressing force of the support plate, and moving toward the first input unit.

According to another aspect of the invention, there is provided a paper sheet processing apparatus comprising a paper sheet supply unit which supplies paper sheets input by stacking in a stand-up state to a take-out position sequentially from a paper sheet placed at one end of the stacking direction; a pickup roller which rotates while contacting the paper sheet supplied to the take-out position, and takes out the paper sheet onto a feeding path; an inspection unit which inspects the paper sheet taken out and fed on the feeding path; and a processor which processes the paper sheet according to the result of inspection in the inspector, wherein the paper supply unit has a first input unit which inputs a first paper sheet by stacking in a stand-up state; a backup plate which presses a paper sheet placed at the other end of the direction of stacking the first paper sheet input to the first input unit in a first direction toward a pickup roller provided at one end of the first input unit, so as to press a paper sheet placed at one end of the stacking direction to the pickup roller; a second input unit which is connected continuously to the other end of the fist input unit and inputs a second paper sheet by stacking in a stand-up state; a support plate which is placed between the backup plate and second paper sheet, supports a paper sheet placed at one end of the direction of stacking the second paper sheet input to the second input unit, and presses the second paper sheet in a second direction reverse to the first direction along the stacking direction; and an evacuation mechanism which evacuates the backup plate and support plate from between the first paper sheet and second paper sheet, after pressing the second paper sheet in the first direction against the pressing force of the support plate, and moving toward the first input unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, embodiments of the present invention will be explained in detail with reference to the accompanying drawings.

Figure 1:
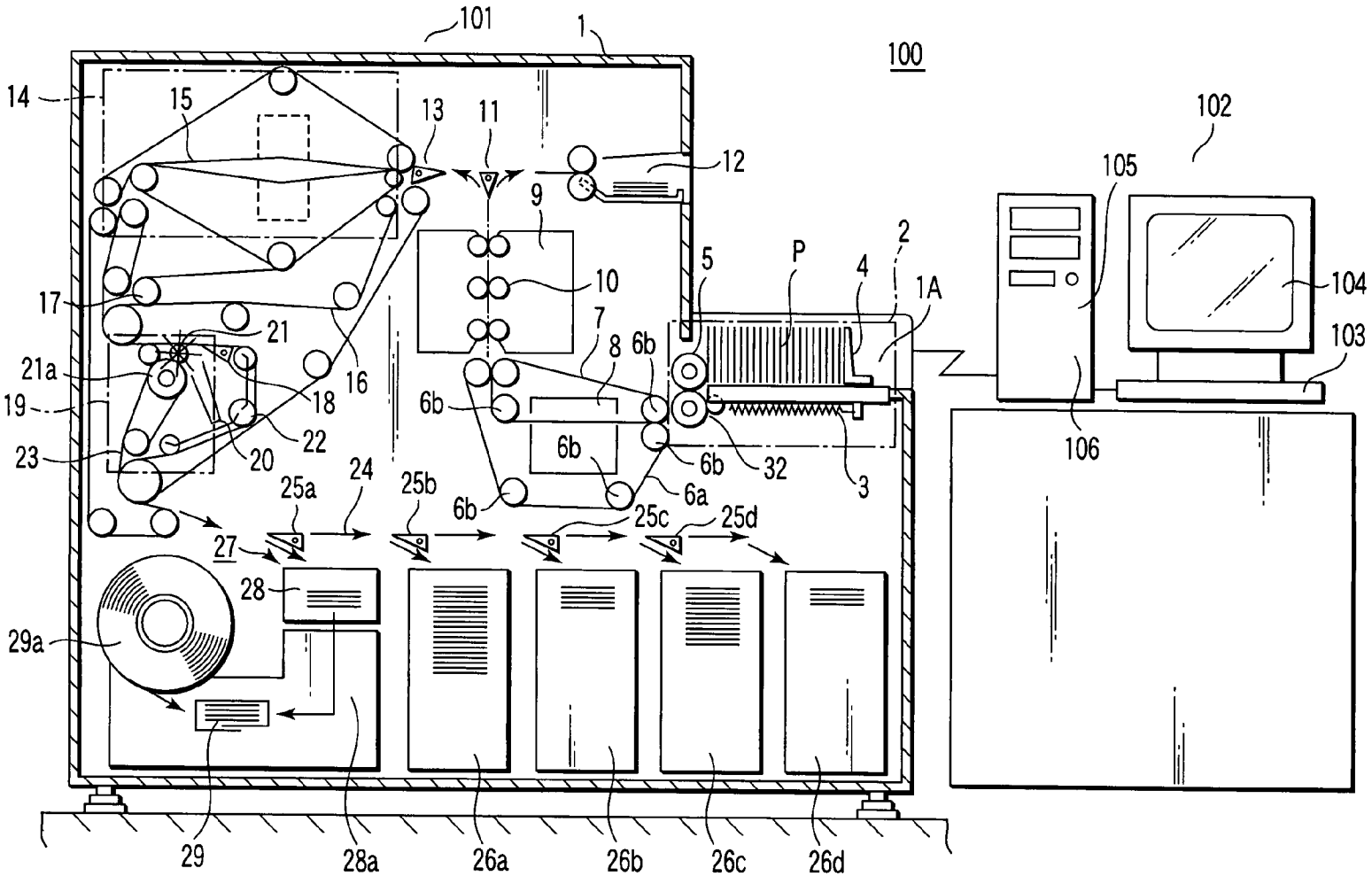
FIG. 1 is a schematic diagram showing a paper sheet processing apparatus according to an embodiment of the present invention.

FIG. 1 schematically shows the configuration of a paper money sorting system 100 (hereinafter called simply a system) as a paper sheet processing apparatus according to an embodiment of the invention. The system 100 has a paper money sorting machine 101, and a control unit 102 for operating and controlling the paper money sorting machine 101.

The control unit 102 consists of a personal computer, for example, and has an operation input unit 103 such as a keyboard and mouse, a display unit 104, a control unit 105, and a hard disc unit 106 for recording.

The paper sorting machine 101 has a housing 1. A table unit 1A is provided at the center of one side of the housing 1. The table unit 1A is provided with a paper money supply unit 2 (paper sheet supply unit) for inputting paper sheets P in a stacked state.

The paper money P is stacked in a stand-up state in the paper supply unit 2. The paper money P is pressed to a pickup roller 5 by a backup plate 4 energized by a spring 3. The paper money P placed at one end of the stacking direction is taken out downward in the drawing by the rotation of the pickup roller 5. The paper money supply unit 2 will be explained in detail later.

Under the pickup roller 5, a separating unit 32 and a feeding unit 37 (magnified in FIG. 2) are provided.

The paper money P fed through the feeding unit 37 described later is fed by a clamp-type feeding unit 7 consisting of a belt 6*a* and a roller 6*b*. The feeding unit 7 is provided with a position correcting unit 8 which automatically corrects a shift and skew of the taken-out paper money P.

An inspection unit 9 is provided in the downstream side of the paper money feeding direction of the feeding unit 7. The inspection unit 9 reads various information from the surface of the paper money P fed by a pair of rollers 10 by not-shown optical sensors, and logically operates and compares the information with reference information, thereby checking double take-in, stain, damage, amount of money, and 4 directions of top/bottom and front/back.

A first branching unit 11 is provided in the downstream side of the paper money feeding direction of the inspection unit 9. The first branching unit 11 leads a paper money judged not a normal paper money P in the inspection unit 9, such as a paper money doubly taken in or skewed largely over a preset level, to a rejection box 12, and a paper money judged a normal paper money P to a second branching unit 13.

The second branching unit 13 branches the paper money P feeding direction into first and second directions. A left/right reversing path 14 is provided in the first direction. The left/right reversing path 14 has a twisting belt 15 to reverse the paper money P 180° to the left and right. A simple belt conveyer 16 is provided in the second direction, to convey the paper money P in as it is. The paper money branched and fed in the first and second directions are joined in a joining unit 17. The lengths of the routes to the joining part 17 are made equal, so that an interval is not shifted after the paper money is joined.

A third branching unit 18 is provided in the downstream side of the paper money feeding direction of the joining unit 17. The third branching unit 18 branches the paper money P feeding direction into third and fourth directions. A switchback unit 19 is provided in the third direction. The switchback unit 19 is provided with a reversing box 20, and a tapping wheel 21 which presses the rear end of the paper money P led to the reversing box 20 to the reversing roller 21*a*. The paper money P is fed out from the reversing box 20 with the top and bottom reversed.

A simple belt conveyer 22 is provided in the fourth direction, and the paper money P is fed while keeping the position. The paper money branched and fed in third and fourth directions is joined in the joining unit 23. The lengths of the routes of the branching path to the joining unit 23 are set equal, so that an interval is not shifted after the paper money is joined.

A horizontal feeding path 24 is provided in the downstream side of the paper money feeding direction of the joining part 23. The horizontal feeding path 24 is provided with fourth to seventh branching units 25*a*-25*d*, which is one less than the number of the parts to be divided. Under the branching units 25*a*-25*d*, first to fourth stacker units 26*a*-26*d* are provided as stacking units for different kinds of paper money. The paper money P is horizontally stacked in the stacker units 26*a*-26*d*.

Under the fourth branching unit 25*a*, a 100-sheet sealing unit 27 is provided. The 100-sheet sealing unit 27 has a stacker 28 to classify the paper money P by stacking 100 sheets, a feeder 28*a* to feed the paper sheet P from the stacker 28, and a belt binder 29 to bind the paper P fed from the feeder 28 with a paper belt 29*a*.

Figure 2:
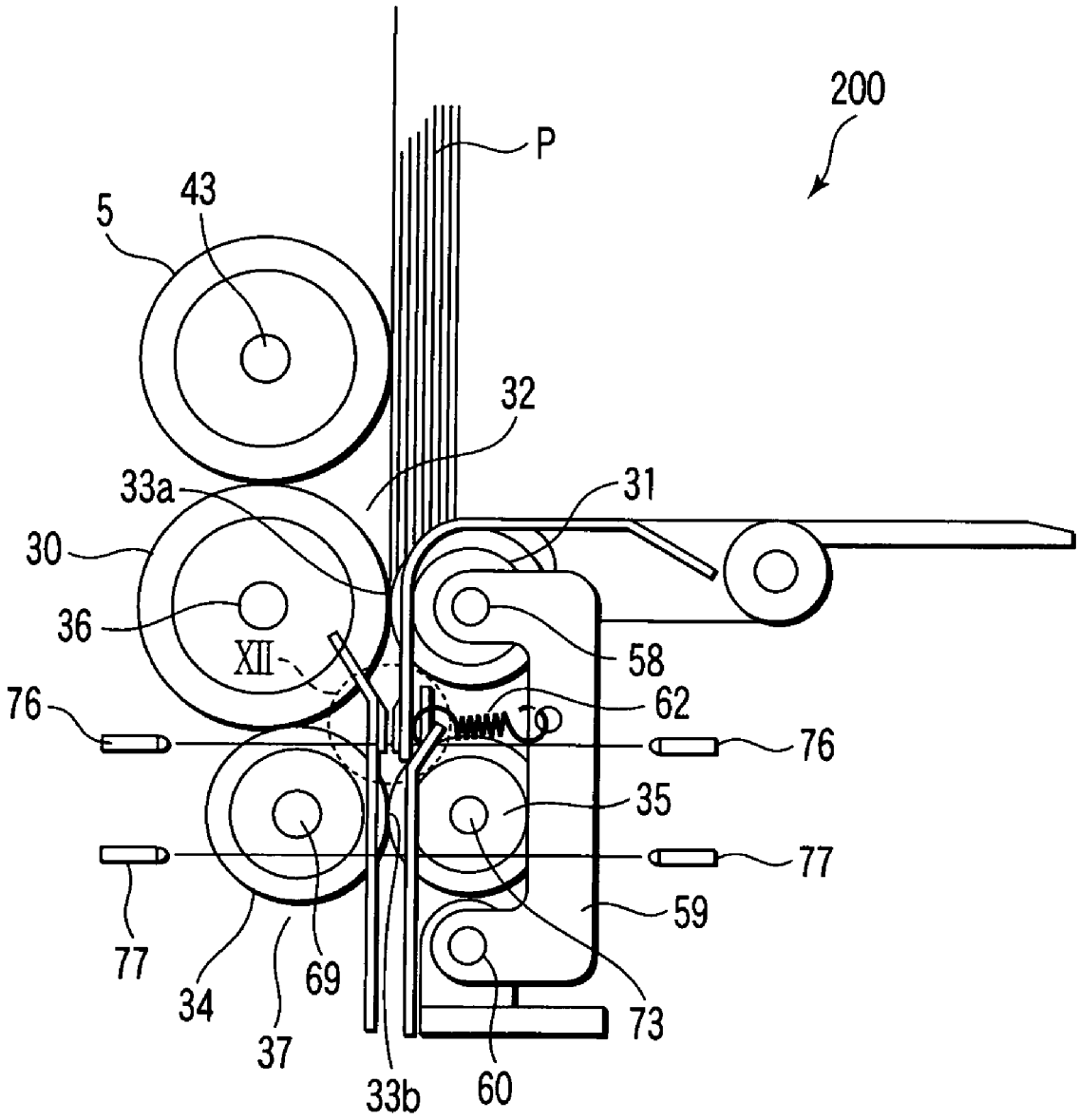
FIG. 2 is a schematic diagram showing a take-out unit incorporated in the paper sheet processing apparatus of FIG. 1.

FIG. 2 schematically shows the structure of a take-out unit 200, which separates one by one the paper money P input through the paper money supply unit 2, and takes it out onto the feeding path. The take-out unit 200 has a separator 32 and a feeder 37, in addition to the pickup roller 5. Each roller (not shown) explained below shall have two rollers along its axis of rotation.

The separator 32 has feeding rollers 30. These feeding rollers 30 are pressed by separating rollers 31. The feeding rollers 30 are provided contacting the surface of the paper money P that is rollingly contacted by the pickup roller 5.

The feeder 37 is located under the feeding rollers 30, and provided with driving rollers 34. The driving rollers 34 are rollingly contacted by pinch rollers 35.

Therefore, the paper money P passing through a separating nip 33*a* between the feeding rollers 30 and separating rollers 31 is clamped and pulled out by a feeding nip 33*b* between the driving rollers 34 and pinch rollers 35, and fed to a processor in a later stage.

The pickup roller 5, feeding roller 30, separating roller 31, driving roller 34 and pinch roller 35 are provided one each on the left and right along the direction of the longish side of paper money, and function to take out the paper money P along the direction of the shorter side.

The peripheral surface of the feeding roller 30 is made of rubber, and fixed to a shaft 36 through a one-way clutch. The feeding roller 30 is freely rotatably in the paper money P take-out direction, and devised to decrease resistance when the paper money P is pulled out by the driving roller 34 and pinch roller 35.

The whole periphery of the separating roller 31 is formed by rubber, and a coefficient of friction to the paper money P is higher than that between the paper money P. The separating roller 31 is rotatably fixed to the upper end portion of an oscillation lever 59 through a shaft 58. The lower end portion of the oscillation lever 59 is rotatably supported by a shaft 60. The oscillation lever 59 is energized by a spring 62, and presses the separating roller 31 to the feeding roller 30. The separating roller 31 is rotated with the feeding roller 30 in the take-out direction, but the reversing torque is always acted in the reversing direction, generating a separating force to the paper money P.

The driving roller 34 is rotatably fixed to a frame through a shaft 69. The pinch roller 35 is rotatably supported by a shaft 73. Both end portions of the shaft 73 are energized toward the driving roller 34 by a not-shown spring. The pinch roller 35 is pressed to the driving roller 34 by this energizing force, and generates a feeding force.

Between the feeding roller 30 and a pair of conveying rollers 34/35, a first detector 76 is provided to detect the paper money P fed out from the separating nip 33*a* between the feeding roller 30 and separating roller 31. In the vicinity of the feed-out side of the pair of conveying rollers 34 and 35, a second detector 77 is provided to detect the paper money P fed out from the pair of conveying rollers 34 and 35. The first and second detectors 76 and 77 are photo-transmissive optical sensors, for example.

Now, the operation of the take-out unit 200 will be explained.

Before the operation is started, paper money P as a processing object is input in a stacked state through the paper money supply unit 2. The input paper money P is energized toward the pickup roller 5 by the backup plate 4, and the paper money P placed at one end of the stacking direction is pressed to the pickup roller 5.

When a take-out start button is pressed through the operation input unit 103 in this state, the pickup roller 5 and feeding roller 30 are rotated and the paper money P is taken out. In this time, the driving roller 34 is rotated at a constant speed, and the separating roller 31 is given a constant torque.

When the pickup roller 5 is rotated, the paper money P pressed to the roller 5 by the backup plate 4 and placed at one end of the stacking direction is taken out downward. In this time, a second and subsequent paper money may be taken out together with the first taken-out paper money P by the friction between the paper money P. If two or more paper money P are taken out together with the first paper money P, the second and subsequent paper money are separated by a reverse direction torque generated by the separating roller 31, when passing through the separating nip 33*a* between the feeding roller 30 and separating roller 31.

After separating from the second and subsequent paper money as above described, the first paper money P is held by the feeding nip 33*b* between the pair of conveying rollers 34 and 35, pulled out from the separating nip 33*a*, and fed to a processor in a later stage.

Figure 3C:
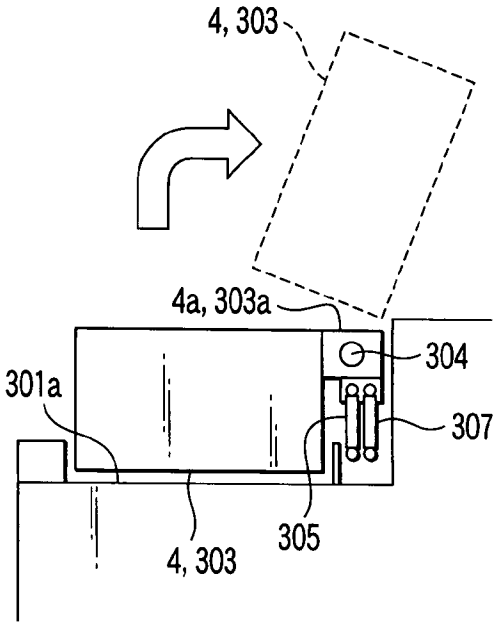
FIG. 3C is a side view of the essential part of the paper money supply unit of FIG. 3A.
Figure 3B:
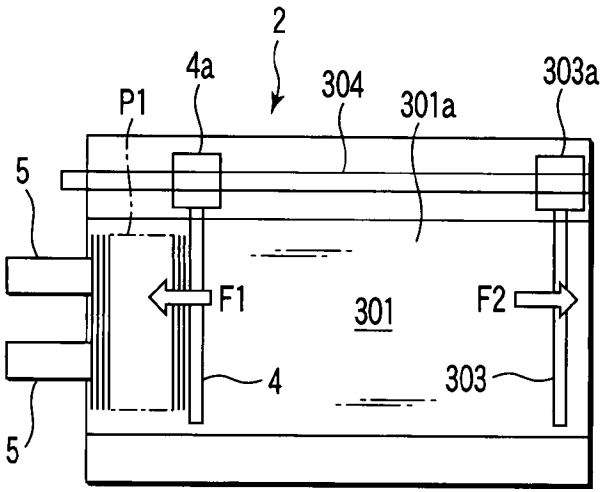
FIG. 3B is a plane view of the essential part of the paper money supply unit of FIG. 3A.
Figure 3A:
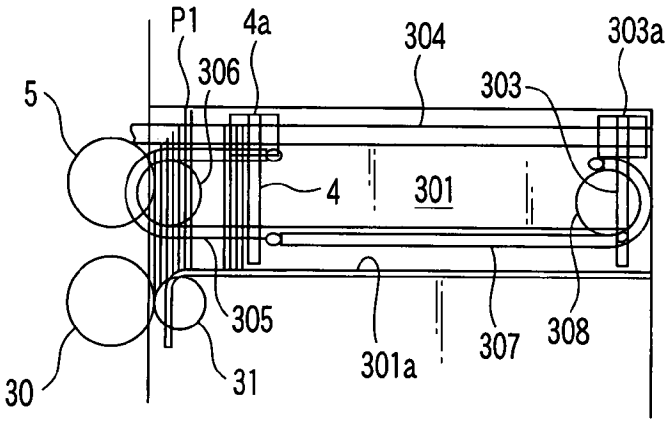
FIG. 3A is a schematic front view showing the structure of a paper money supply unit incorporated in the paper sheet processing apparatus of FIG. 1.

Now, detailed explanation will be given on the structure of the paper supply unit 2 with reference to FIG. 3A, FIG. 3B, FIG. 3C and FIG. 4. FIG. 3A shows a front view of a first input unit 301 of the paper money supply unit 2, viewed from the front side of the paper sheet processing apparatus 100. FIG. 3B shows a plane view of the first input unit 301, viewed from the top. FIG. 3C shows a side view of the first input unit 301, viewed from the upstream side of the paper money P supplying direction.

The paper money supply unit 2 has a first input unit 301 which inputs paper money P1 by stacking in a stand-up state, and a second input unit 302 which inputs paper money P2 by stacking in a stand-up state. The pickup rollers 5 are placed at one end of the first input unit 301 along the paper money P1 stacking direction. In this embodiment, the second input unit 302 is assumed to haven been externally connected to the other end of the first input unit 301, apart from the pickup rollers 5.

The paper money P1 and P2 input to the first and second input units 301 and 302 are of not different kind. Here, the paper money of a batch to be input first to the paper money supply unit 2 is called P1 (first paper sheet), and the paper money of a batch to be input next to the paper supply unit 2 is called P2 (second paper sheet).

The first input unit 301 is also provided with a plate 303 to support the paper money P2 input to the second input unit 302, in addition to the backup plate 4. In the rear of the first input unit 301, a slid shaft 304 is provided extending in the direction of stacking the paper money P1 and P2 (e.g., in the lateral direction in FIG. 4). One end of the backup plate 4 and support plate 303 is rotatably fixed to the slide shaft 304 as shown in FIG. 3C, and slidable along the slide shaft 304 in the direction of stacking the paper money P.

A slider 4*a* is used to fix the backup plate 4 rotatably to the slid shaft 304. One end of a pressing spring 305 is fixed to the slider 4*a*, and the other end of the pressing spring 305 is fixed to the housing of the apparatus. The midstream part of the pressing spring 305 is laid over a pulley 306. Therefore, the backup plate 4 is always energized by the pressing spring 305 in the direction (first direction) indicated by an arrow F1 in FIG. 3B, and presses the paper money placed at the other end of the stacking direction in the first direction (to the left in the drawing) toward the pickup rollers 5, just like pressing the paper money placed at one end of the direction of stacking the paper money P1 input to the first input unit 301, to the pickup roller 5.

A slider 303*a* is used to fix the support plate 303 rotatably to the slide shaft 304. One end of a constant-load spring 307 is fixed to the slider 303*a*, and the other end of the spring 307 is fixed to the housing of the apparatus. The midstream of the constant-load spring 307 is laid over a pulley 308. The constant-load spring 307 functions to give a constant load at all times regardless of the slide position of the slider 303*a*.

Figure 4:
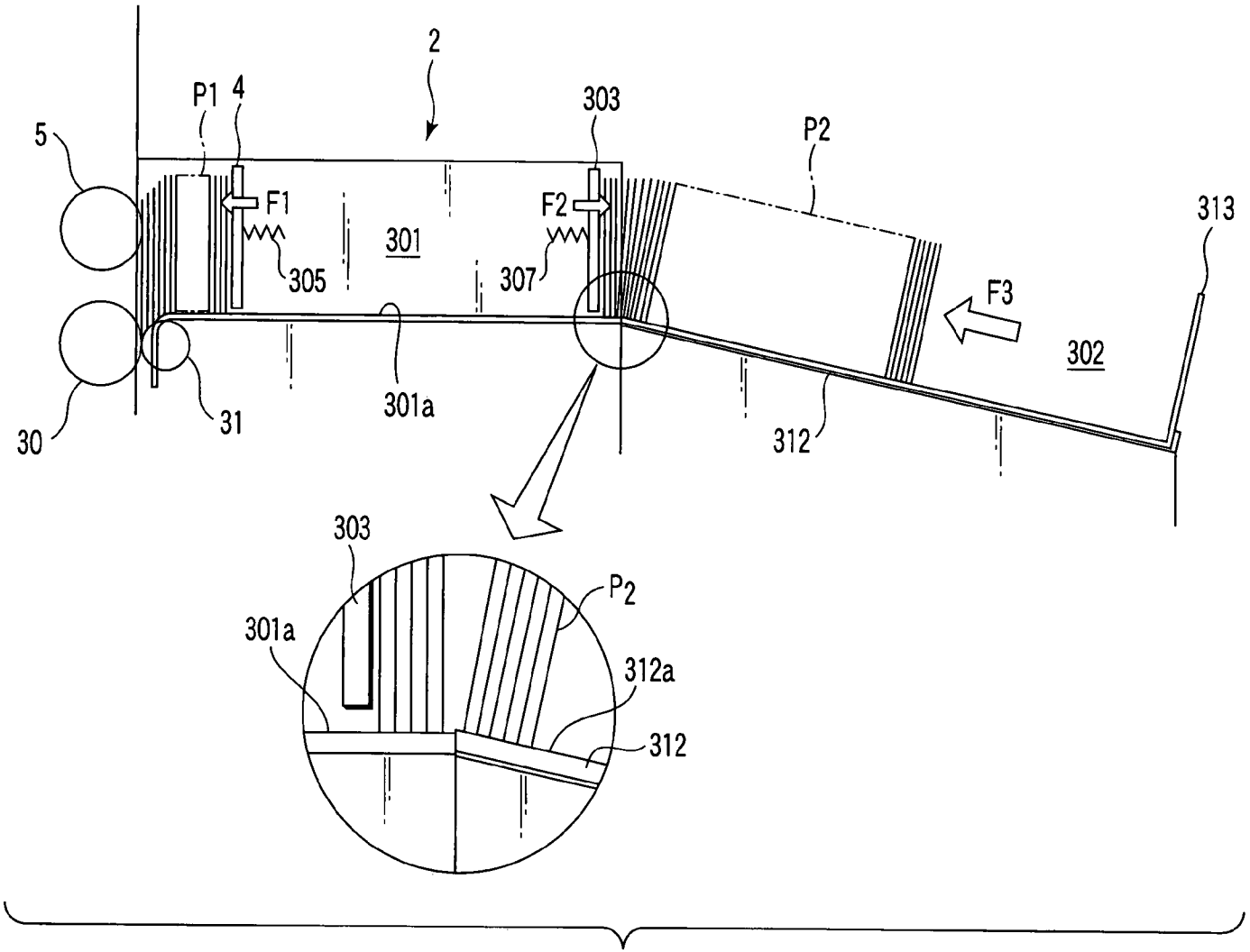
FIG. 4 is a schematic diagram showing the whole paper supply unit.

Therefore, when the paper money P2 input to the second input unit 302 is manually pressed by the operator to the direction of an arrow F3 in the drawing as shown in FIG. 4, the support plate 303 presses the paper money P2 in the direction of an arrow F2 in the drawing (second direction) to prevent the paper money placed at one end of the paper money P2 stacking direction from falling down to the pickup rollers 5. In this time, the support plate 303 is moved to the pickup rollers 5 together with the paper money P2 by the pressing force F3 by the operator, and placed close to the backup plate 4.

The above-mentioned slide shaft 304 and sliders 4*a* and 303*a* function also as an evacuation mechanism of the present invention. Namely, the backup plate 4 having the slider 4*a* and the support plate 303 having the slider 303*a* can be evacuated from the first input unit 301 by rotating these plates upward around the slide shaft 304 as indicated by a broken line in FIG. 3A, and the paper money P1 and P2 can be joined.

Figure 6:
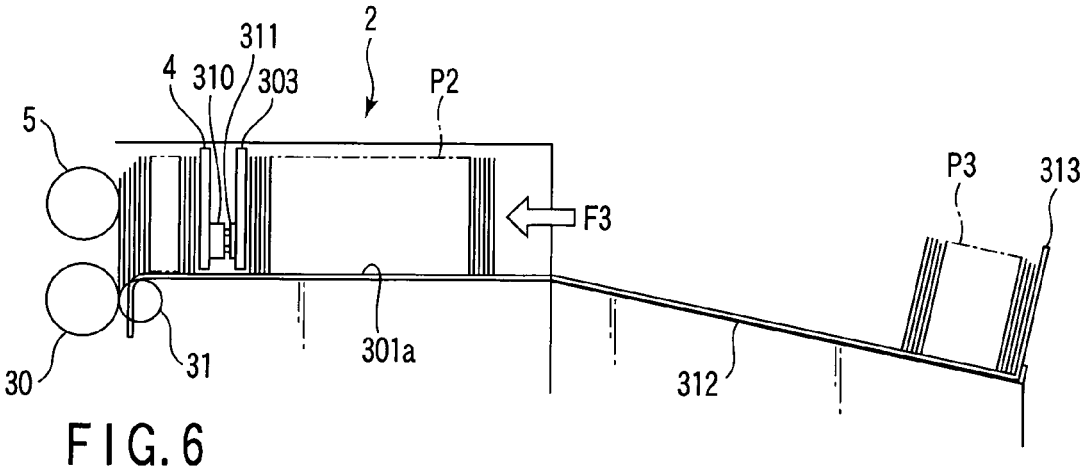
FIG. 6 is a view for explaining the operation in the paper money supply unit of FIG. 4.

For example, as shown in FIG. 6, a magnet 310 is provided on the back of the backup plate 4 opposed to the support plate 303, and a magnetic member 311 is provided on the back of the support plate 303 opposed to the backup plate 4. Namely, the magnet 310 and magnetic member 311 are removably connected by the magnetism when the backup plate 4 and support plate 303 are moved close to each other, and functioned to combine these plates as one body. The plates 4 and 303 can be evacuated as one body around the slid shaft 304. The magnet 310 and magnetic member 311 may be reversely provided.

A supply case 312 containing paper money P2 is removably set in the second input unit 302. The supply case 312 has a rear wall 313 which supports the paper money placed at the other end apart from the pickup rollers 5 along the paper money P2 stacking direction, and opens one end of the paper money P2 stacking direction to the support plate 303. The second input unit 302 is inclined downward in the direction of separating away from the pickup rollers 5. The inclined angle can be optionally changed according to the kinds of paper sheets to be handled.

Namely, the paper money P2 input to the second input unit 302 slides by the own weight on a bottom surface 312*a* of the case toward the rear wall 313 of the supply case 312, and the paper money placed at the other end of the stacking direction is supported by the rear wall 313. This prevents loosing the position of the paper money P2 in the state that the supply case 312 is set in the second input unit 302.

The height of the bottom surface 312*a* of the supply case 312 set in the second input unit 3 is designed a little higher than the bottom surface 301*a* of the first input unit 301, as shown partially magnified in FIG. 4. By taking a slight height difference between the bottom surface 301*a* of the first input unit 301 and the bottom surface 312*a* of the supply case 312, a defect of getting the paper P2 trapped in the part connecting the supply case and first input unit, when moving the paper money P2 from the supply case 312 to the first input unit 301.

Next, an explanation will be given on the operation of the paper money supply unit 2 with the above-described structure with reference to FIG. 5-FIG. 7. In the explanation, the paper money P1 is input to the first input unit 301 and taken out by the pickup rollers 5. While the paper money P1 is being taken out, the supply case 312 containing the paper money P and P3 parted by a header card (not shown) is set in the second input unit 302. Only the paper money P is additionally supplied to the first input unit 301.

Figure 5:
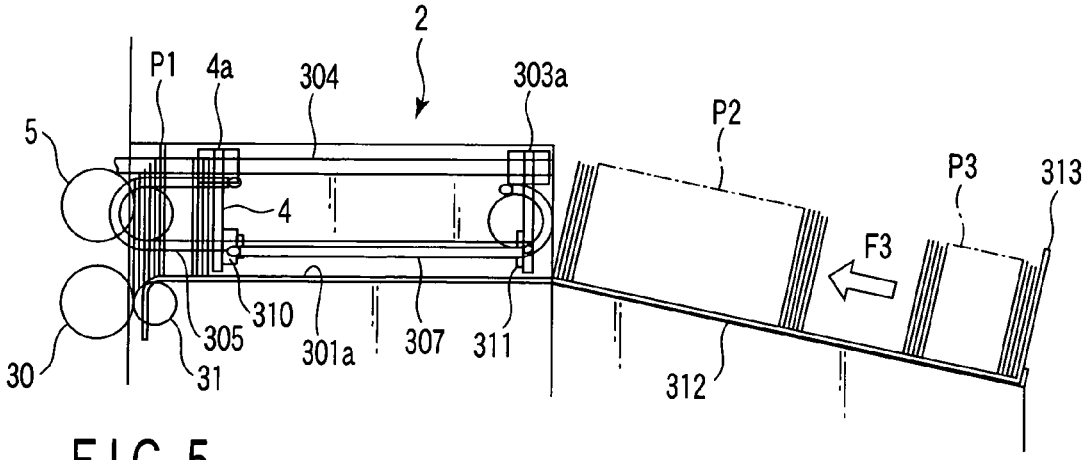
FIG. 5 is a view for explaining the operation in the paper money supply unit of FIG. 4.

First, as shown in FIG. 5, set the supply case 312 containing the paper money P2 and P3 in the second input unit 302, and press the paper money P2 to the direction of the arrow F3 in the drawing by the operator's manual operation. In this time, the operator separates the paper money P2 and P3 by taking the header card as a guide, and moves the paper money P2 to the first input unit 301 by sliding the lower end side of the paper money P2 along the bottom surface 312*a*.

The paper money P3 remained in the supply case 312 in the second input unit 302 is energized downward by the own weight along the inclined bottom 312*a* of the supply case 312, and the rear end of the stacking direction is supported by the rear wall 313 of the case to prevent collapsing of the stack.

When the paper money P2 is moved to the pickup rollers 5 by the operator, the paper money placed at one end of the stacking direction is brought to contact with and supported by the support plate 303 standing by at the entrance of the first input unit 301. This prevents falling down of the paper money placed at one end. The support plate 303 may be set by a not-shown stopper in proximity to the entrance of the first input unit 301, or may be placed in the second input unit 302 by extending the slide shaft 304 to the second input unit 302.

When the paper money P2 is pressed in the direction of the arrow F3 and pushed into the first input unit 301 by the operator, the paper money P2 is held between the support plate 303 and the operator's hand, with the paper money placed at one end supported by the support plate 303, and moved toward the pickup rollers 5 together with the support plate 303. In this time, the operator presses the paper money P2 by the pressing force F3 against the pressing force F2 given by the constant-load spring 307 of the support plate 303.

In this time, the lower end side of the paper money P2 passes through the part connecting the lower surface 312*a* of the supply case 312 and the lower surface 301*a* of the first input unit 301. However, as explained hereinbefore, as the lower surface 312*a* is placed a little higher than the lower surface 301*a*, the lower end side of the paper money P2 is not caught by the height difference causing a jam.

As shown in FIG. 6, when all the paper money P2 is moved to the first input unit 301, the support plate 303 contacts the backup plate 4 at the end of the movement. Concretely, the magnet 310 fixed to the backup plate 4 is connected to the magnetic member 311 fixed to the support plate 303 by the magnetism, and the two plates 4 and 303 are combined as one body.

Thereafter, the combined backup plate 4 and support plate 303 are rotated around the slide shaft 304 from the position indicated by a solid line to the position indicated by a broken line in FIG. 3C, and evacuated upward from between the paper money P1 and P2. FIG. 7 shows this state. Therefore, the additionally supplied paper P2 is joined with the paper money P1 previously input to the first input unit 301.

Figure 7:
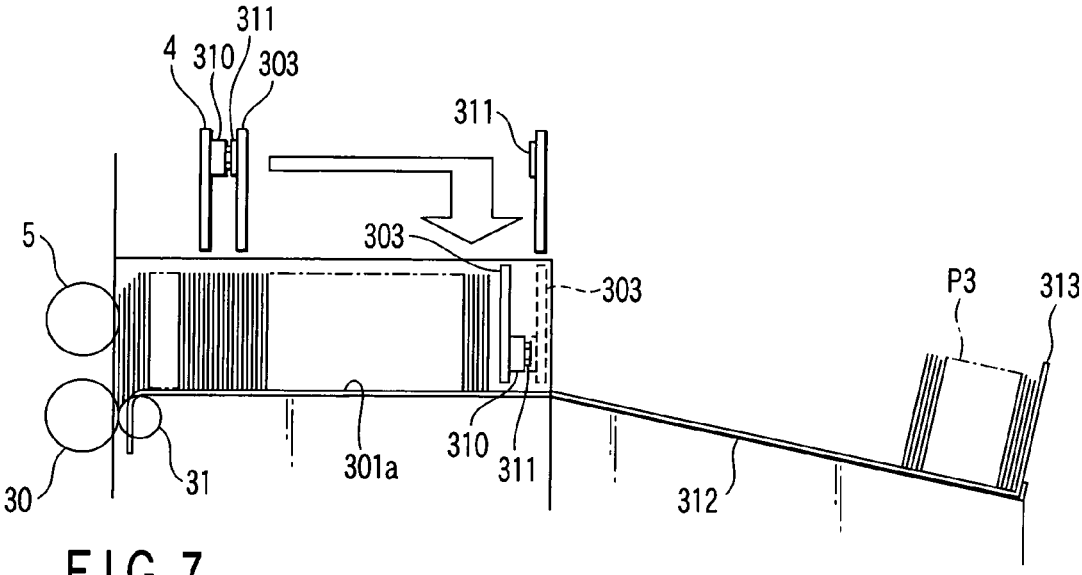
FIG. 7 is a view for explaining the operation in the paper money supply unit of FIG. 4.

Then, the two plates 4 and 303 evacuated upward are moved in the direction of separating away from the pickup rollers 5 along the slide shaft 304 as indicated by an arrow in FIG. 7, and rotated from the position indicated by a broken line to the position indicated by a solid line in FIG. 3C, and placed at the rear end of the additionally supplied paper money P2.

In this state, the energizing force F1 given to the backup plate 4 is larger than the energizing force F2 given to the plate 303, and the paper money P2 supplied to the first input unit 301 is energized toward the pickup rollers 5. The paper money P2 is additionally supplied by the above operation.

After the paper money P is additionally supplied as explained above, the support plate 303 may be separated from the backup plate 4 by moving from the position indicated by a broken line to the position indicated by a solid line in FIG. 7, and may be lifted upward. By separating the support plate 303 after additionally supplying the paper money P2, the influence of the energizing power F2 given to the support plate 303 on the energizing force F1 by the backup plate can be prevented, and the paper money pressing force to the pickup rollers 5 can be always kept constant. Even if the support plate 303 is remained connected to the backup plate 4, the spring 307 energizing the support plate 303 is a constant-load spring, and the pressing force of the backup plate 4 is not changed during the paper money take-out process.

As described hereinbefore, according to the above embodiments, one end of the additionally supplied paper money close to the pickup roller is supported by the plate 303, and the other end of the money separated from the pickup roller is held and pressed by the operator's hand. This increases the ease of operation by the operator, particularly when paper money is additionally supplied.

Further, according to the embodiments, additionally supplied paper can be set in the supply case 312 and input by one operation, and it is possible to prepare two or more supply cases containing processing paper money as pretreatment for the processing by the paper sheet processing apparatus 100. This permits continuous additional supply of paper money without stopping the paper sheet processing apparatus 100, and increases the availability of the apparatus. Further, the operation of setting paper money in the supply case can be separated from the operation of setting the supply case in the apparatus, and the operations can be shared by different operators. This increases the work efficiency.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, in the above embodiments, paper money is processed as paper sheets. The processing material is not limited to paper money. The present invention can be applied to an apparatus, which processes postal matter and other card medium.

What is claimed is:

1. A paper sheet supply apparatus comprising:

a first input unit which inputs a first paper sheet by stacking in a stand-up state;

a backup plate which presses a paper sheet placed at the other end of the direction of stacking the first paper sheet input to the first input unit in a first direction toward a pickup roller provided at one end of the first input unit, so as to press a paper sheet placed at one end of the stacking direction to the pickup roller;

a second input unit which is connected continuously to the other end of the first input unit and inputs a second paper sheet by stacking in a stand-up state;

a support plate which is placed between the backup plate and second paper sheet, supports a paper sheet placed at one end of the direction of stacking the second paper sheet input to the second input unit, and presses the second paper sheet in a second direction reverse to the first direction along the stacking direction;

an evacuation mechanism which evacuates the backup plate and support plate from between the first paper sheet and second paper sheet, after pressing the second paper sheet in the first direction against the pressing force of the support plate, and moving toward the first input; and a magnet which removably connects the backup plate and support plate.

2. The paper sheet supply apparatus according to claim 1, wherein the evacuation mechanism has a slide. shaft which holds the backup plate and support plate slidable in the first and second directions, and evacuates the backup plate and support plate from between the first and second paper sheets by rotating the backup plate and support plate in the state connected by the magnet.

3. The paper sheet supply apparatus according to claim 2, wherein the backup plate and support plate are slid in the second direction along the slide shaft, and placed at the other end of the second paper sheet stacking direction, after evacuated from between the first and second paper sheets.

4. The paper sheet supply apparatus according to claim 1, further comprising a supply case which contains the second paper sheet, and is removably set in the second input unit.

5. The paper sheet supply apparatus according to claim 4, wherein the supply case has a rear wall to support the paper sheet placed at the other end of the second paper sheet stacking direction.

6. The paper sheet supply apparatus according to claim 5, wherein the second input unit is inclined downward toward the second direction.

7. The paper sheet supply apparatus according to claim 1, wherein the bottom surface of the second input unit contacting the lower end side of the second paper sheet is placed a little higher than the bottom surface of the first input unit contacting the lower end side of the first paper sheet, in a part connected to the first input unit.

8. A paper sheet processing apparatus comprising:

a paper sheet supply unit which supplies paper sheets input by stacking in a stand-up state to a take-out position sequentially from a paper sheet placed at one end of the stacking direction;

a pickup roller which rotates which contacting the paper sheet supplied to the take-out position, and takes out the paper sheet onto a feeding path;

an inspection unit which inspects the paper sheet taken out and fed on the feeding path; and a processor which processes the paper sheet according to the result of inspection in the inspector, wherein the paper supply unit has a first input unit which inputs a first paper sheet by stacking in a stand-up state;

a backup plate which presses a paper sheet placed at the other end of the direction of stacking the first paper sheet input to the first input unit in a first direction toward a pickup roller provided at one end of the first input unit, so as to press a paper sheet placed at one end of the stacking direction to the pickup roller;

a second input unit which is connected continuously to the other end of the first input unit and inputs a second paper sheet by stacking in a stand-up state;

a support plate which is placed between the backup plate and second paper sheet, supports a paper sheet placed at one end of the direction of stacking the second paper sheet input to the second input unit, and presses the second paper sheet in a second direction reverse to the first direction along the stacking direction;

an evacuation mechanism which evacuates the backup plate and support plate from between the first paper sheet and second paper sheet, after pressing the second paper sheet in the first direction against the pressing force of the support plate, and moving toward the first input unit; and a magnet which removably connects the backup plate and support plate.

9. The paper sheet processing apparatus according to claim 8, wherein the evacuation mechanism which has a slide shaft which holds the backup plate and support plate slidable in the first and second directions, and evacuates the backup plate and support plate from between the first and second paper sheets by rotating the backup plate and support plate in the state connected by the magnet.

10. The paper sheet processing apparatus according to claim 9, wherein the backup plate and support plate are slid in the second direction along the slide shaft, and placed at the other end of the second paper sheet stacking direction, after evacuated from between the first and second paper sheets.

11. The paper sheet processing apparatus according to claim 8, further comprising a supply case which contains the second paper sheet, and is removably set in the second input unit.

12. The paper sheet processing apparatus according to claim 11, wherein the supply case has a rear wall to support the paper sheet placed at the other end of the second paper sheet stacking direction.

13. The paper sheet processing apparatus according to claim 12, wherein the second input unit is inclined downward toward the second direction.

14. The paper sheet processing apparatus according to claim 8, wherein the bottom surface of the second input unit contacting the lower end side of the second paper sheet is placed a little higher than the bottom surface of the first input unit contacting the lower end side of the first paper sheet, in a part connected to the first input unit.

* * * * *